US005873189A

United States Patent [19]

Menke

[11] Patent Number: 5,873,189

[45] Date of Patent: Feb. 23, 1999

[54] BENCH-REST RIFLE

[76] Inventor: Martin Menke, Sölling 1, D-46359 Heiden, Germany

[21] Appl. No.: 919,797

[22] Filed: Aug. 29, 1997

[51] Int. Cl.[6] ..... F41C 23/00

[52] U.S. Cl. ..... 42/71.01; 42/94

[58] Field of Search ..... 42/71.01, 94, 72; 89/37.01

[56] References Cited

U.S. PATENT DOCUMENTS

| | | | |
|---|---|---|---|
| 2,104,129 | 1/1938 | Kress | 42/71 |
| 3,012,350 | 12/1961 | Wold | 42/94 |
| 4,055,017 | 10/1977 | Thompson | 42/94 |
| 4,558,531 | 12/1985 | Kilby | 42/94 |
| 4,558,532 | 12/1985 | Wright | 42/94 |
| 4,674,216 | 6/1987 | Ruger et al. | 42/71.01 |
| 5,711,102 | 1/1998 | Plaster et al. | 42/71.01 |

OTHER PUBLICATIONS

Article in Visier Magazine dated Dec., 1996.

*Primary Examiner*—Charles T. Jordan
*Assistant Examiner*—Meena Chelliah
*Attorney, Agent, or Firm*—Hill & Simpson

[57] ABSTRACT

A bench-rest rifle is provided having a shaft and a longitudinally extending barrel affixed thereto with a bolt and a system, wherein the shaft has a flat base and two lateral longitudinally extending ribs between which is received the barrel, with the ribs extending vertically in a use position of the rifle. An upper surface of the ribs is convexly curved and protrudes upwards beyond the barrel. A thickness of the base is less than $1/5^{th}$ of an outer diameter of the barrel and may be about $1/10^{th}$ of the outer diameter of the barrel. A longitudinally running and laterally extending ribs may be provided at the front position of the shaft to provide rigidity and stability to the shaft which, preferably, is formed of plastic.

18 Claims, 2 Drawing Sheets

BENCH-REST RIFLE

BACKGROUND OF THE INVENTION

The invention is directed to a rifle, particularly a bench-rest rifle, with a stock, a barrel affixed thereto with a bolt and a system, as well as a telescopic sight that can be attached thereto.

Rifles of this type have long since proven their usefulness for precision shooting. They are able to deliver a number of shots with the highest precision, even at longer distances.

In the known bench-rest rifles, it is disadvantageous that for every shot there occurs a certain tipping motion triggered by the recoil, whereby a renewed aiming of the rifle may be required or, respectively, whereby the shots following the first may no longer be one hundred percent precise.

SUMMARY OF THE INVENTION

The aim of the invention is to create a rifle, in particular a bench-rest rifle, in which the described disadvantages no longer occur, which allows a number of shots with the highest precision without renewed aiming, and which is moreover of simple construction, can be transported without reducing the precision, and offers easier handling.

This aim is inventively solved in the rifle described above in that the stock has a flat base and comprises longitudinal ribs that run vertically in the position of use.

In order to increase the rigidity, in the barrel region the ribs can comprise a convexly curved upper edge that protrudes beyond the barrel, whereby the upper edge can extend to the front edge of the stock.

For easy servicing, the upper edge of the ribs can run in a straight line in the region of the chamber.

In order to exclude or reduce the tendency to tipping, a base of the smallest height is used, whose thickness is less than $1/5^{th}$ of the outer barrel diameter, and which preferably comprises a thickness of only $1/10^{th}$ of the outer barrel diameter.

For the additional rigidity of the stock, the front portion of the stock can comprise lower longitudinally running ribs (extending laterally) in the bearing area, and in order to avoid the disadvantages of the use of wood, the subject matter of the invention can be made of a suitable plastic.

Since the inventive rifle comprises a considerably improved shooting power, accuracy and repeatability, and due to the use of plastic, is not subject to changes of shape, it can be regarded as an ideal solution to the existing problems.

In the following, an exemplary embodiment of the subject matter of the invention is explained in more detail on the basis of drawings.

DETAILED DESCRIPTION OF THE PREFERRED EMBODIMENTS

Figure 1:
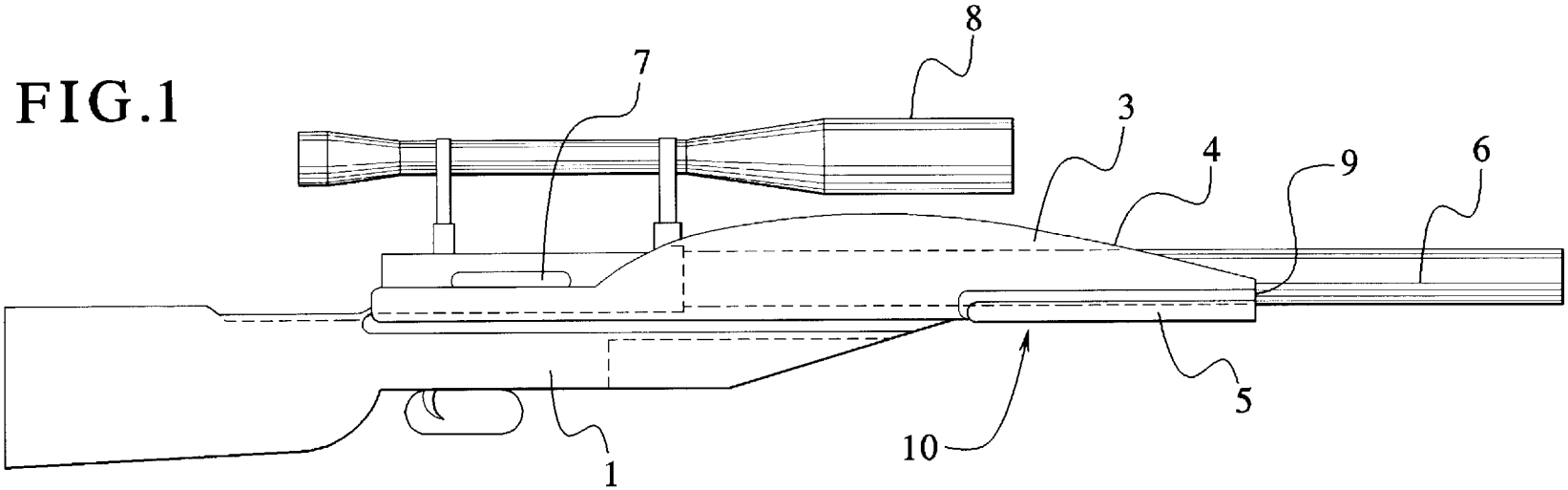
FIG. 1 shows a side view of the inventive rifle.
Figure 2:
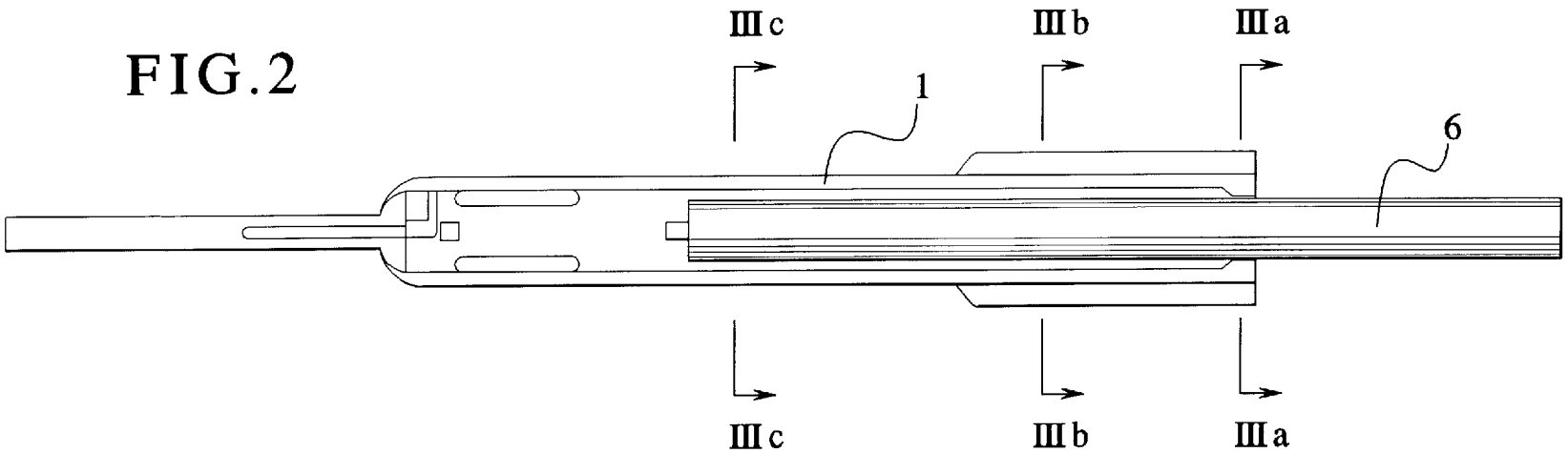
FIG. 2 shows a top view of the inventive rifle.

The inventive rifle, particularly a bench-rest rifle, has in principle the design of a conventional rifle with stock 1, barrel 6 and telescopic sight 8.

The stock 1 comprises a flat bottom surfaced base 2, on which two longitudinal ribs 3, extending vertically in the position of use, are laterally placed.

In the region of the barrel, the ribs 3 comprise a convex curved upper edge 4, whose rounding points upward, and the ribs protrude above the barrel 6.

While the upper edge 4 extends forwardly up to a front end 9 of the stock 1, rearwardly, the rounding terminates shortly before a chamber region 7, and from there the upper edge 4 runs rearwardly in a straight line at a height that does not hinder the loading of cartridges and the servicing of the rifle.

Figure 4A:
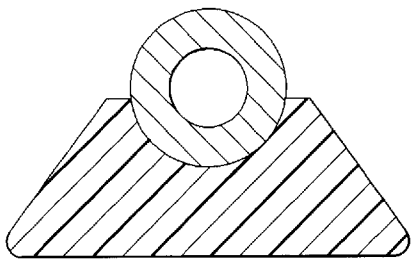
FIG.4a (PRIOR ART)
FIGS. 4*a*, 4*b* and 4*c* show cross-sections of a conventional (prior art) rifle, in the same position as FIGS. 3*a*, 3*b* and 3*c*, respectively.
Figure 4B:
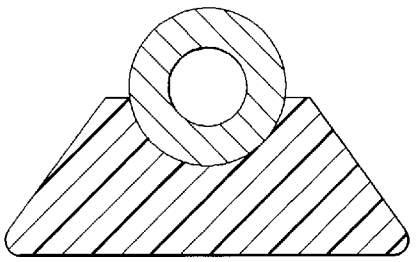
FIG.4b (PRIOR ART)
Figure 4C:
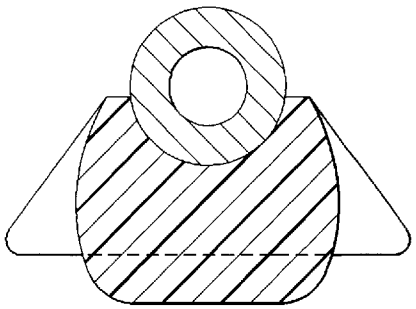
FIG.4c (PRIOR ART)

According to the invention, a thickness T of the base is less than $1/5^{th}$ of the outer barrel diameter D, and is advantageously about $1/10^{th}$ of the outer barrel diameter. This is contrasted with the much thicker base of known supports as shown in FIGS. 4*a*, 4*b* and 4*c*.

Figure 3A:
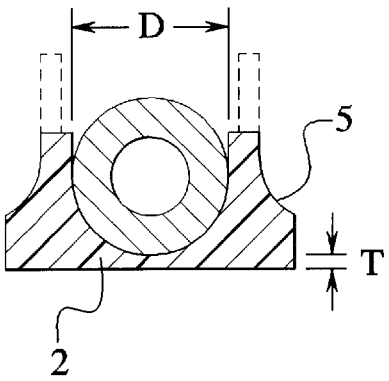
FIGS. 3*a*, 3*b* and 3*c* show three cross-sections taken generally along dotted lines in FIG. 2, seen looking forwardly from the stock.
Figure 3B:
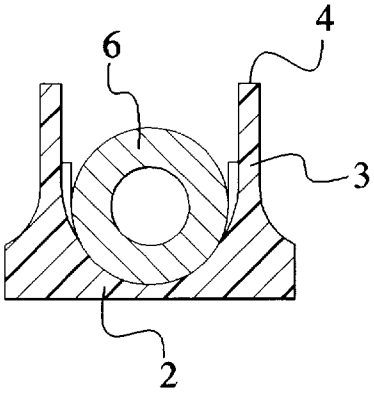
Figure 3C:
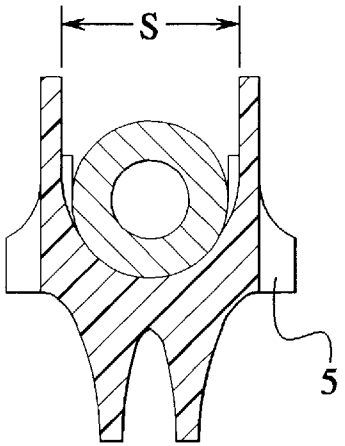

In a front region 10 of the stock 1, lower longitudinally running ribs 5 are present, which however do not negatively affect the prescribed support width in that they extend only laterally. The barrel 6 lies on the barrel rest 2 in a standard way, without touching the lateral ribs 3. That is, the ribs 3 are laterally spaced apart a distance S which is greater than the diameter D of the barrel (FIG. 3). As a whole, the stock is thus constructed in an uncomplicated manner, but the shooting power is improved substantially by the low-lying barrel 6.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A Bench-rest rifle having a stock and a longitudinally extending barrel affixed thereto with a bolt and a system comprising said stock having a flat base and two lateral longitudinally extending ribs, said ribs extending vertically in a use position of said rifle and wherein said ribs, in a region of said barrel, have a convexly curved upper edge which protrudes upwards beyond said barrel.

2. A rifle according to claim 1, wherein said curved upper edge extends to a front edge of said stock.

3. A rifle according to claim 1, wherein said upper edge of said ribs extends rearwardly in a straight line in a region of said bolt.

4. A rifle according to claim 1, wherein a front position of said stock includes lower longitudinal ribs.

5. A rifle according to claim 1, wherein said stock is formed of plastic.

6. A rifle according to claim 1 including a telescopic sight attached to said stock.

7. A bench-rest rifle having a stock and a longitudinally extending barrel affixed thereto with a bolt and a system comprising said stock having a flat base and two lateral longitudinally extending ribs, said ribs extending vertically in a use position of said rifle and wherein said base comprises a thickness of less than $1/5^{th}$ of an outer diameter of said barrel.

8. A rifle according to claim 7, wherein said thickness if about $1/10^{th}$ of said outer diameter of said barrel.

9. A rifle for a bench-rest rifle stock comprising a longitudinally extending member having a flat base and an upper portion provided with a trough separated by a pair of laterally spaced apart, longitudinally extending ribs, in a region for receiving a barrel of said rifle therein with said ribs having a height, at least along a portion of their length greater than half a diameter of said barrel, wherein said ribs have an upper edge in said region which is convexly curved and which extends above a height of said barrel.

10. A rifle stock according to claim 9, wherein said upper edge extends in a curve to a front end of said shaft.

11. A rifle stock according to claim 9, wherein said upper edge, in a rearward direction from said region, extends in a straight line in a region of a bolt of said rifle.

12. A rifle stock according to claim 9, wherein said stock, in a front lower region, comprises longitudinal ribs.

13. A rifle according to claim 9, wherein said stock is formed of plastic.

14. A rifle stock for a bench-rest rifle comprising:

a longitudinally extending member having a flat base and an upper portion provided with a trough separated by a pair of laterally spaced apart, longitudinally extending ribs, in a region for receiving a barrel of said rifle therein with said ribs having a height, at least along a portion of their length greater than half a diameter of said barrel, wherein said base has a thickness at said trough of less than $1/5^{th}$ of an outer diameter of said barrel.

15. A rifle stock according to claim 14, wherein said base has a thickness at said trough of about 1/10 of said outer diameter of said barrel.

16. A bench-rest rifle comprising:

a stock;

a barrel affixed to said stock, said barrel having a bolt and a system, said stock having a flat bottomed base with two laterally spaced ribs, extending longitudinally vertically therefrom, in the position of use of said rifle, said barrel being positioned between said two ribs, said ribs having an upper edge which is convexly curved in a forward portion thereof, extending to a front end of said stock, and a straight upper edge at a rearward portion in the region of said bolt.

17. A bench-rest rifle according to claim 16, wherein said upper edge, at least along a portion of its length, extends above a height of said barrel.

18. A bench-rest according to claim 17, wherein said base has a thickness of less than about $1/5^{th}$ of an outer diameter of said barrel.

* * * * *